US005464353A

United States Patent [19]

Saijo et al.

[11] Patent Number: 5,464,353

[45] Date of Patent: Nov. 7, 1995

[54] LOCK CONNECTOR

[75] Inventors: Eiji Saijo; Masashi Saito; Takeshi Tsuji, all of Yokkaichi, Japan

[73] Assignee: Sumitomo Wiring Systems, Ltd., Mie, Japan

[21] Appl. No.: 221,244

[22] Filed: Mar. 31, 1994

[30] Foreign Application Priority Data

| | | | |
|---|---|---|---|
| Apr. 21, 1993 | [JP] | Japan | 5-119171 |
| Apr. 21, 1993 | [JP] | Japan | 5-119172 |
| Apr. 21, 1993 | [JP] | Japan | 5-119173 |

[51] Int. Cl.[6] ..... H01R 3/00

[52] U.S. Cl. ..... 439/489; 439/188

[58] Field of Search ..... 439/188, 350, 439/352, 354, 488, 489, 490, 79; 200/51.09, 51.1

[56] References Cited

U.S. PATENT DOCUMENTS

| | | | |
|---|---|---|---|
| 3,611,261 | 10/1971 | Gregory . | |
| 4,316,647 | 2/1982 | Bailey et al. | 439/354 |
| 4,904,196 | 2/1990 | Sueyoshi et al. . | |
| 4,917,627 | 4/1990 | Hendricks . | |
| 5,061,204 | 10/1991 | Murakami | 439/489 |
| 5,131,865 | 7/1992 | Taguchi et al. . | |
| 5,158,473 | 10/1992 | Takahashi et al. | 439/489 X |
| 5,234,357 | 8/1993 | Yamaguchi | 439/354 |
| 5,277,608 | 1/1994 | Oda | 439/188 |

FOREIGN PATENT DOCUMENTS

| | | |
|---|---|---|
| 0440330 | 8/1991 | European Pat. Off. . |
| 2-50982 | 4/1990 | Japan . |
| 3-272578 | 12/1991 | Japan . |

*Primary Examiner*—Khiem Nguyen
*Attorney, Agent, or Firm*—Oliff & Berridge

[57] ABSTRACT

A lock connector for normally biasing a flexible lock piece in the upward direction includes a short circuit electrode disposed on the upper surface of a female connector housing. Two lock detecting electrodes are held at positions in a male connector housing by the elastic restoring action of the flexible lock piece. Thus, a restoring operation of the flexible piece and short-circuiting between the cooperating terminals can simultaneously be achieved without any deviation from the correct timing relationship established among the components.

6 Claims, 7 Drawing Sheets

LOCK CONNECTOR

BACKGROUND OF THE INVENTION

The present invention relates to a lock connector which can reliably detect that a pair of connector housings are electrically connected to each other by way of short-circuiting in the locked state.

A known lock connector of the foregoing type is shown in the disassembled state in FIG. 11. Referring to the drawing, a male connector housing 1 is fixedly mounted on a base plate 2 and includes a pair of lock detecting electrodes 4*a* and 4*b* on the opposite side parts of a positioning piece 3 having an inverted T-shaped cross-sectional contour as shown in FIG. 12. On the other hand, as shown in the drawing, a female connector housing 5 includes a substantially U-shaped short circuit electrode 6 of which one end is projected to come in contact with the opposite side parts of the positioning piece 3 and of which other end is connected to a main body of the female connector housing 5. Incidentally, to assure that the short circuit electrode 6 is not brought in contact with the lock detecting electrodes 4*a* and 4*b* by curvedly bending the short circuit electrode 6 in the upward direction at the beginning time when the short circuit electrode 6 is fitted into the connector housing 1 on the male side, a pair of guide projections 3*b* are formed on the opposite sides of an upright standing partition wall portion 3*a* of the positioning piece 3.

On the other hand, a flexible lock piece 7 is formed integral with the female connector housing 5 on the upper surface of the latter, and a protuberance 7*a* is formed on the upper surface of the flexible lock piece 7. In addition, an engagement hole 1*a* adapted to be engaged with the protuberance 7*a* of the flexible lock piece 7 is formed on the upper surface of the male connector housing 1.

With such construction, as the flexible lock piece 7 on the female connector housing 5 is inserted into the male connector housing 1 while it is curvedly bent, the short circuit electrode 6 is curvedly bent in the slantwise upward direction by the guide projections 3*b* as shown in FIG. 13. When the female connector housing 5 is completely inserted in the male connector housing 1, the protuberance 7*a* of the flexible lock piece 7 is engaged with the engagement hole 1*a* of the male connector housing 1, and at the same time, the short circuit electrode 6 is parted away from the guide projections 3*b* and comes in contact with the lock detecting electrodes 4*a* and 4*b* as shown in FIG. 14. The lock detecting electrodes 4*a* and 4*b* are electrically connected to a detecting circuit (not shown) by way of short-circuiting, and when the detecting circuits detects that short circuit takes place with the lock connector, it determines that the connector housing 1 on the male side and the connector housing 5 on the female side are firmly held in the locked state relative to each other.

With the conventional lock connector constructed in the above-described manner, to assure that detection reliability is improved, it is necessary that the time when the protuberance 7*a* of the flexible lock piece 7 is engaged with the engagement hole 1*a* on the male connector housing 1 correctly matches with the time when the short circuit electrode 6 comes in contact with the lock detecting electrodes 4*a* and 4*b*. However, as far as the aforementioned conventional lock connector is concerned, many difficulties appear when it is practically produced, because a molding accuracy should be improved, and moreover, an accuracy on the position where the short circuit electrode 6 is disposed should be elevated.

Further, since elasticity of the flexible lock piece 7 molded integral with the female connector housing 5 is increasingly degraded as time elapses, there arises a malfunction that the female connector housing 5 is vibratively received in the male connector housing 1. Once the female connector housing 5 is vibratively received in the male connector housing 1 in that way, the short circuit electrode 6 is incorrectly brought in contact with the lock detecting electrodes 4*a* and 4*b*, resulting in the locked state between both the connector housings 1 and 5 being erroneously detected. When a separate spring is disposed in the lock connector so as to cope with the foregoing problem, this leads to the result that the number of components constituting the conventional lock connector is undesirably increased.

Furthermore, it is necessary that the male connector housing 1 is constructed such that the protuberance 7*a* formed on the upper surface of the flexible lock piece 7 is received in the engagement hole la formed on the upper surface of the male connector housing 1 when the female connector housing 5 is fitted into the male connector housing 1. This leads to the result that the male connector housing 1 is unavoidably enlarged in dimension.

SUMMARY OF THE INVENTION

The present invention has been made in consideration of the aforementioned background and its object resides in providing a lock connector which assures that detection reliability can easily be improved.

Further object resides in providing a lock connector which assures that there does not arise a malfunction that the locked state between both the connector housings is erroneously detected regardless of the time that elapses since one connector housing is received in another connector housing and that the number of components separately or additionally disposed in the lock connector is not increased.

To accomplish the above object, according to the first aspect of the present invention, there is provided a lock connector including one connector housing having a lock piece formed thereon, another connector housing having an engagement portion formed therein and a detecting member for detecting the locked state between both the connector housings, the flexible lock piece of the one connector housing being brought in engagement with the engagement portion of the other connector housing, wherein the lock connector is characterized in that the connector housing having the engagement portion formed therein is fixedly secured to a member to be immovably held and includes a pair of lock detecting electrodes at the position where the flexible lock piece comes in contact with the engagement portion, and that the connector having the flexible lock piece formed therein includes a short circuit electrode on the upper surface side thereof where the flexible lock piece is normally biased toward the engagement portion, the short circuit electrode being electrically connected to the pair of lock detecting electrodes by way of short-circuiting at the position facing to the pair of lock detecting electrodes.

According to the second aspect of the present invention, there is further provided the connector housing having the flexible lock piece formed thereon includes a leaf spring made of a sheet of metallic material between the flexible lock piece and the connector housing having the flexible lock piece formed thereon, and that a pair of short circuit electrode portions adapted to be electrically connected to the pair of lock detecting electrodes by way of short-circuiting are formed at one end of the leaf spring on the upper surface of the latter at the positions where the short circuit electrode portions face to the lock detection electrodes.

According a third aspect of the present invention, there is further provided the flexible lock piece of the one connector housing being brought in engagement with the engagement portion of the other connector housing, wherein said lock connector is characterized in that the engagement portion of the connector housing having the engagement portion formed therein is prepared in the form of a partition wall extending in the connector housing having the engagement portion formed therein toward the flexible lock piece of the connector housing having the flexible lock piece formed therein and a pair of lock detecting electrodes are disposed with the partition wall interposed therebetween, that an engagement hole serving to make it possible to bring a part of the partition wall in engagement with the engagement hole is formed on the connector housing having the flexible lock hole formed thereon at the position located opposite to the partition wall while the flexible lock piece is correctly brought in contact with the engagement portion, and that a short circuit electrode adapted to be electrically connected to the pair of lock detecting electrodes by way of short-circuiting is disposed in the connector housing having the flexible lock piece formed thereon, and that a short circuit electrode adapted to be electrically connected to the pair of lock detecting electrodes by way of short circuiting is disposed in the connector housing having the flexible lock piece formed thereon while a part of the short circuit electrode is normally biased toward the flexible lock piece having the engagement hole formed through the latter and the foregoing part of the partition wall is seized by the short circuit portion.

With the lock connector constructed according to the first aspect of the present invention, when the one connector housing having the flexible lock piece formed therein is fitted into the other connector housing having the engagement portion formed therein, the flexible lock piece is restored to the original position to bring the flexible lock piece in the locked state after the lock piece is deflected. At this time, the short circuit electrode disposed on the upper surface side where the flexible lock piece is normally biased toward the engagement portion is electrically connected by way of short-circuiting to the pair of lock detecting electrode disposed at the position where the flexible lock piece comes in contact with the engagement portion. On the other hand, since the lock detecting electrodes are held in the connector housing fixedly secured to the member to be immovably held, holding accuracy can easily be improved, resulting in locked state detecting accuracy being likewise easily improved.

According to the second aspect of the present invention, when the connector housing having the flexible lock piece formed thereon is fitted into the connector housing having the engagement portion formed therein, the flexible lock piece is restored to the original position to assume a locked state after it is elastically deflected. At this time, the leaf spring disposed between the flexible lock piece and the connector housing normally biases the flexible lock piece so as not to allow the one connector housing to be vibratively received in the other connector housing. In addition, since a pair of short circuit electrode portions are formed at one end of the leaf spring and located on the upper surface side of the latter where the flexible lock piece is normally biased toward the engagement portion, when the flexible lock piece is restored to the original position, the pair of short circuit electrode portions on the leaf spring are electrically connected to the lock detecting electrodes by way of short-circuiting.

According to the third aspect of the invention, the engagement hole is formed through the flexible lock piece without any protuberance disposed on the latter. Thus, as the connector housing having the flexible lock piece formed thereon is inserted into the connector housing having the engagement portion formed therein, a part of the partition wall of the engagement portion is received in the engagement hole to come in engagement with the latter. When the flexible lock piece is elastically restored to the original position to assume a locked state after it is deflected, the short circuit electrode disposed in the connector housing having the flexible lock piece formed therein is brought in contact with the pair of lock detecting electrodes to make electrical connection therebetween by way of short-circuiting while a part of the short circuit electrode is normally biased toward the flexible lock piece having the engagement hole formed through the latter and the foregoing part of the partition wall is seized by the short circuit electrode.

As is apparent from the above description, when the flexible lock piece in the one connector housing is restored to the original position so as to bring it in the locked state, the lock detecting electrodes come in contact with the short circuit electrode to make electrical connection therebetween. In addition, the other connector housing having the lock detecting electrodes formed therein is fixedly mounted on the member to be immovably held, causing the lock detecting electrodes to be stably held in the other connector housing. Consequently, the present invention has provided a lock connector which makes it possible to easily improve the locked state detecting accuracy.

As is apparent from the above description, with the lock connector constructed according to the present invention, since a part of the short circuit electrode serves as a leaf spring for resiliently biasing the flexible lock piece serves also as a short circuit electrode in the upward direction, there does not arise a malfunction that the one connector housing is vibratively received in the other connector housing regardless of a period of time which elapses from the time when both the connector housings are fitted to each other in the locked state. In addition, there does not arise another malfunction that the locked state between both the connector housings is erroneously detected.

As is apparent from the above description, with the lock connector constructed according to the present invention, since a part of the partition wall extending toward the flexible lock piece from the engagement portion side is received in the engagement hole to come in engagement with the latter, the lock connector can be constructed in a compact manner compared with the conventional lock connector including a protuberance on the flexible lock piece side. In addition, since the lock detecting electrodes each serving as a detecting member when the flexible lock piece is restored to the original position to assume an engaged state come in contact with the short circuit electrode, the present invention can provide a lock connector which makes it possible to improve a lock detecting accuracy.

DETAILED DESCRIPTION PREFERRED EMBODIMENTS OF THE INVENTION

The present invention will now be described in detail hereinafter with reference to the accompanying drawings which illustrate a preferred embodiments thereof.

Figure 1:
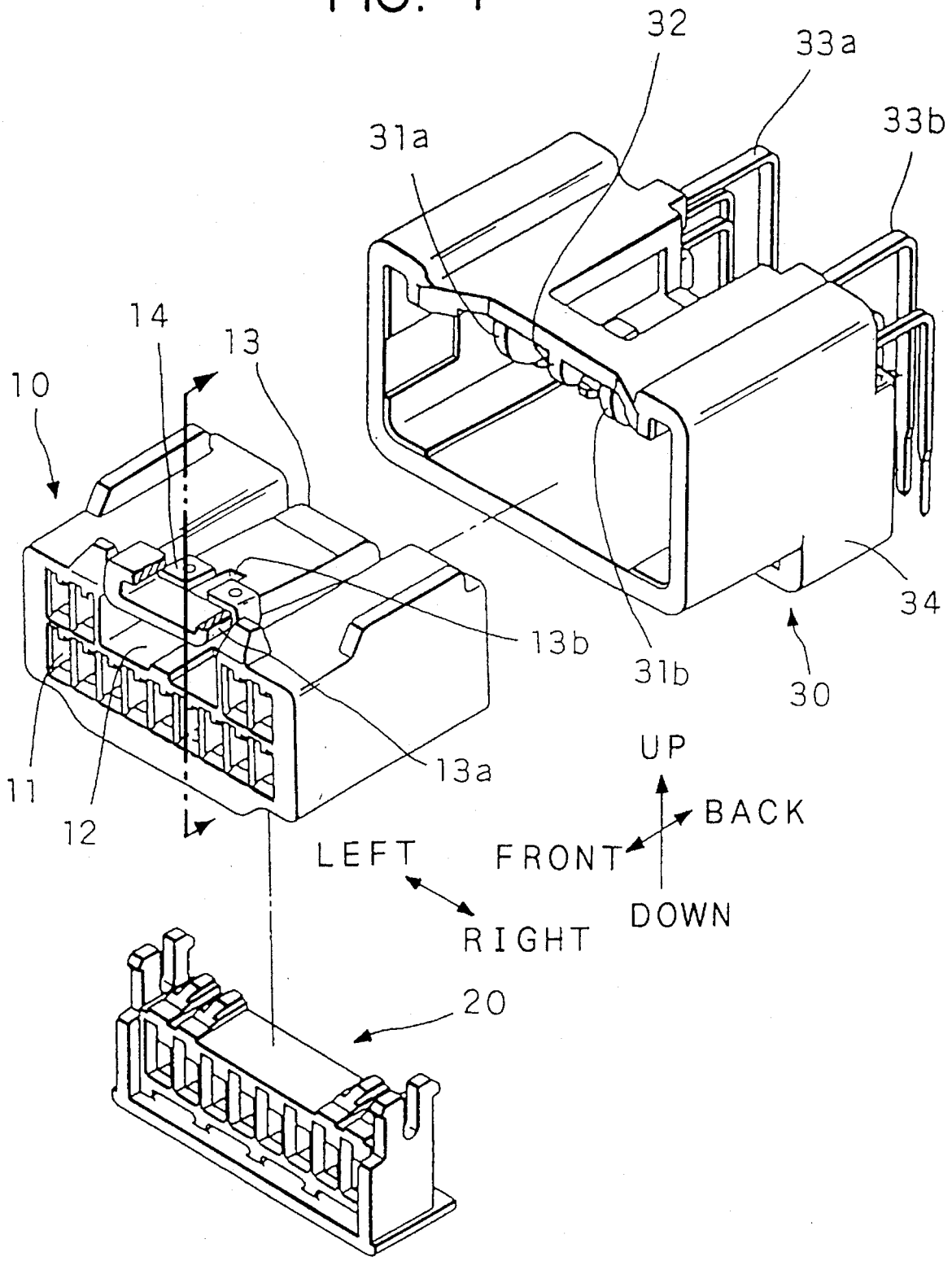
FIG. 1 is a perspective view of a lock connector constructed according to the present invention.

FIG. 1 is a perspective view of a lock connector constructed according to an embodiment of the present invention.

Referring to the drawing, a connector housing 10 on the male side includes a plurality of small chambers 11 each formed therethrough in the axial direction of cables, and each of the small chambers 11 serves to hold a female terminal inserted thereinto not only in the provisionally engaged state but also in the normally engaged state with the aid of a retainer 20. In addition, an axially extending groove-like recess 12 is formed at the intermediate part of the upper surface of the female connector housing 10, and a flexible lock piece 13 is formed in the recess 12 while extending from the rear side toward the front side in the slantwise upward direction. A pinching portion 13*a* is formed at the foremost end part of the flexible lock piece 13, and moreover, an axially extending elongated engagement hole 13*b* is formed through the flexible lock piece 13 at the position located slightly behind the pinching portion 13*a*.

Figure 2:
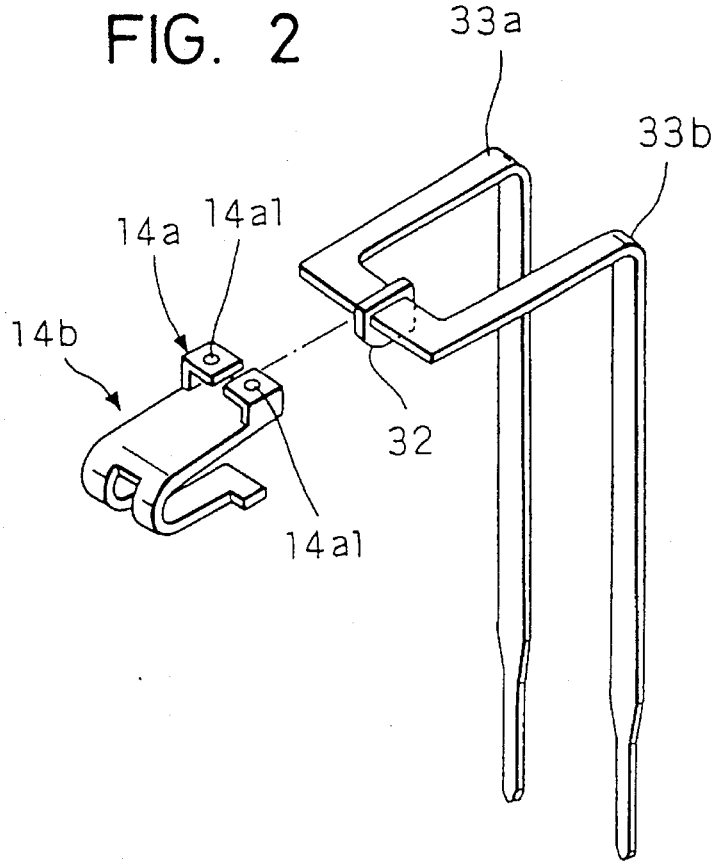
FIG. 2 is a perspective view of a short circuit electrode and a lock detecting electrode.

The flexible lock piece 13 is provided with a short circuit electrode 14 as shown in FIG. 2. The short circuit electrode 14 is composed of an electrode portion 14*a* for holding a part of the flexible lock piece 13 in the engagement hole 13*b* in the clamped state with the aid of a pair of electrode portions 14*a* and a spring portion 14*b* having a U-shaped sectional contour and integrated with the electrode portions 14*a*, and the lowermost end of the spring portion 14*b* comes in contact with the bottom surface of the recess 12. It should be noted that a pair of contact protuberances $14a_1$ are formed on the upper surfaces of the electrode portions 14*a*.

On the other hand, a male connector housing 30 is designed in the hood-shaped configuration in such a manner as to enable the female connector housing 10 to be inserted into the male housing 30, and a plurality of male terminals each adapted to be electrically connected to a female terminal are supported in the male connector housing 30 at the positions located opposite to the small chambers 11 in the female connector housing 10. In addition, a pair of axially extending position determining ribs 31*a* and 31*b* adapted to come in contact with the opposite side surfaces of the recess 12 for the purpose of position determination are formed on a ceiling surface of the male connector housing 30. Additionally, an engagement rib 32 adapted to be brought in engagement with the engagement hole 13*b* when the female connector housing 10 is inserted into the male connector housing 30 to reach a regular position is formed on the ceiling surface of the male connector housing 30 at the intermediate position between both the position determining ribs 31*a* and 31*b*. The engagement rib 32 includes an inclined part 32*a* at the lower end part on the fore side thereof which slantwise downwardly extends in the rearward direction. In addition, the engagement rib 32 includes a vertically extending part 32*b* at the lower end part on the rear side thereof. As shown in FIG. 2, a pair of lock detecting electrodes 33*a* and 33*b*, of which lower contact surfaces are kept open to the outside, are disposed along a ceiling surface of the male connector housing 30 with the engagement rib 32 interposed therebetween.

The male connector housing 30 includes a fixing portion 34 on the lower surface thereof which is fixedly secured to a printed circuit base board (not shown), and the male terminals held in the male connector housing 30 and the lock detecting electrodes 33*a* and 33*b* are electrically connected to the printed circuit base board.

Next, a mode operation of the lock connector constructed in the aforementioned manner will be described below.

With respect to the female connector housing 10, a plurality of female terminals each having a cable connected thereto by crimping are firmly held in the chambers 11 with the aid of the retainer 20, and the short-circuit electrode 14 is disposed on the flexible lock piece 13. At this time, the upper surface of the spring portion 14*b* of the short circuit electrode 14 comes in contact with the lower surface of the flexible lock piece 13, while the lower surface of the same comes in contact with the upper surface of the recess 12, causing the flexible lock piece 13 to be normally biased in the upward direction. On the other hand, the male connector housing 30 is fixedly mounted on the printed circuit base board via the fixing portion 34.

Figure 3:
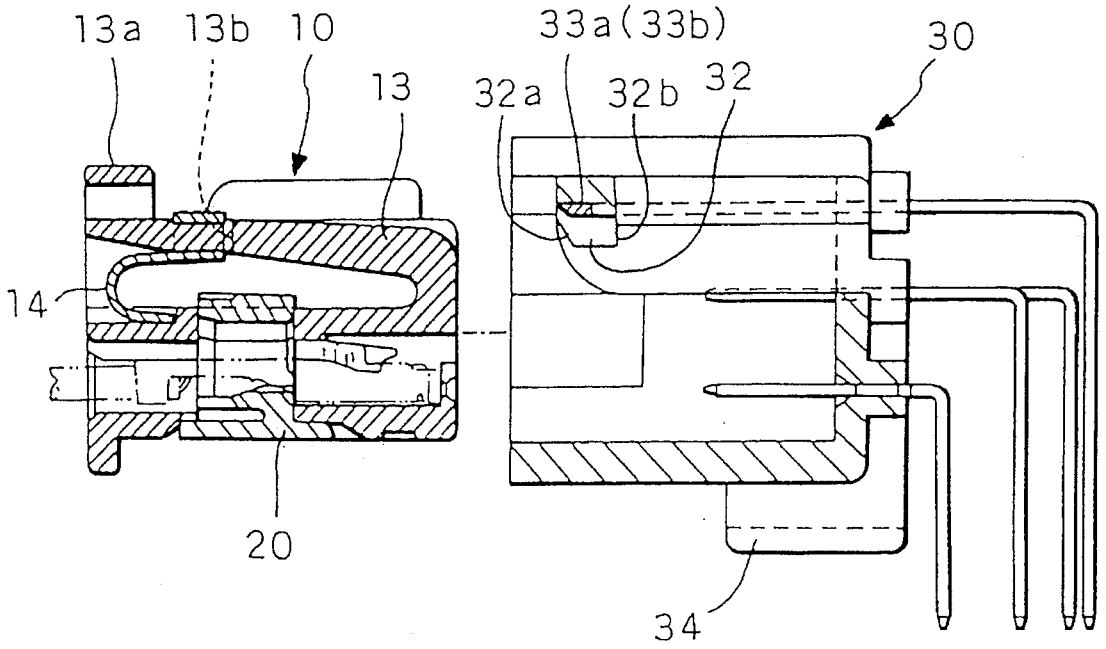
FIG. 3 is a sectional view of the lock connector, particularly showing a procedure for electrically connecting a connector housing on the female side to a connector housing on the male side by way of short-circuiting.

As shown in FIG. 3, the female connector housing 10 is located opposite to the male connector housing 30, and subsequently, the former is inserted into the latter in such a manner that the position determining ribs 31*a* and 31*b* on the latter are received in the recess 12 of the former.

Figure 4:
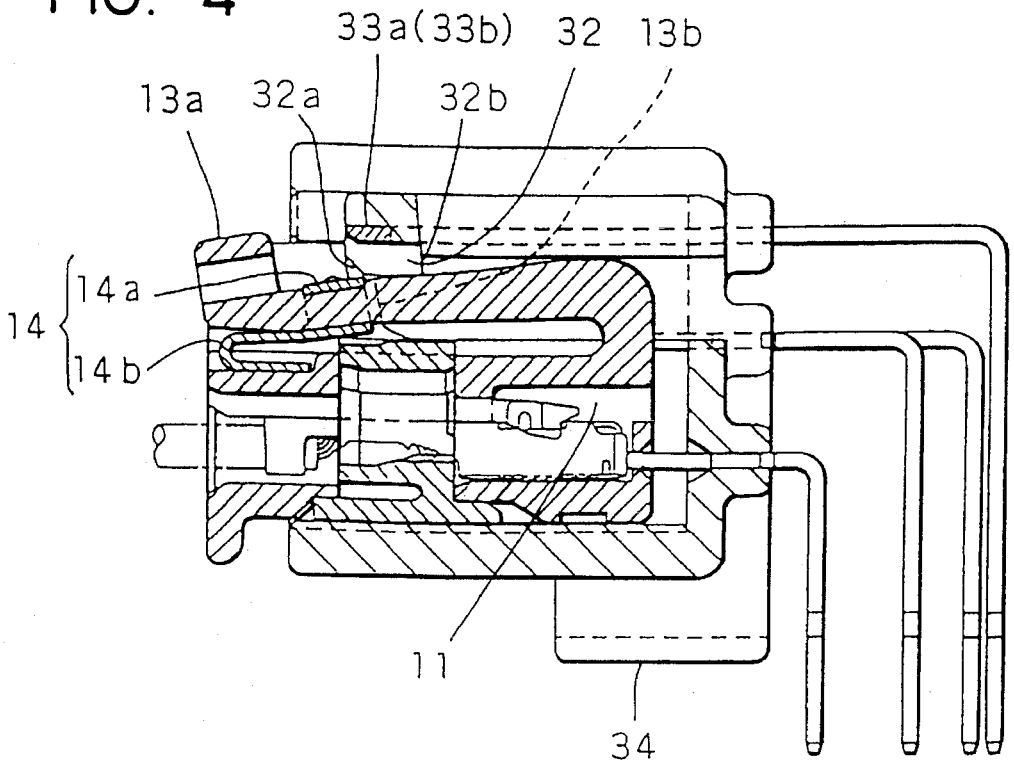
FIG. 4 is other sectional view of the lock connector, particularly showing a procedure for electrically connecting a connector housing on the female side to a connector housing on the male side by way of short-circuiting.
Figure 5:
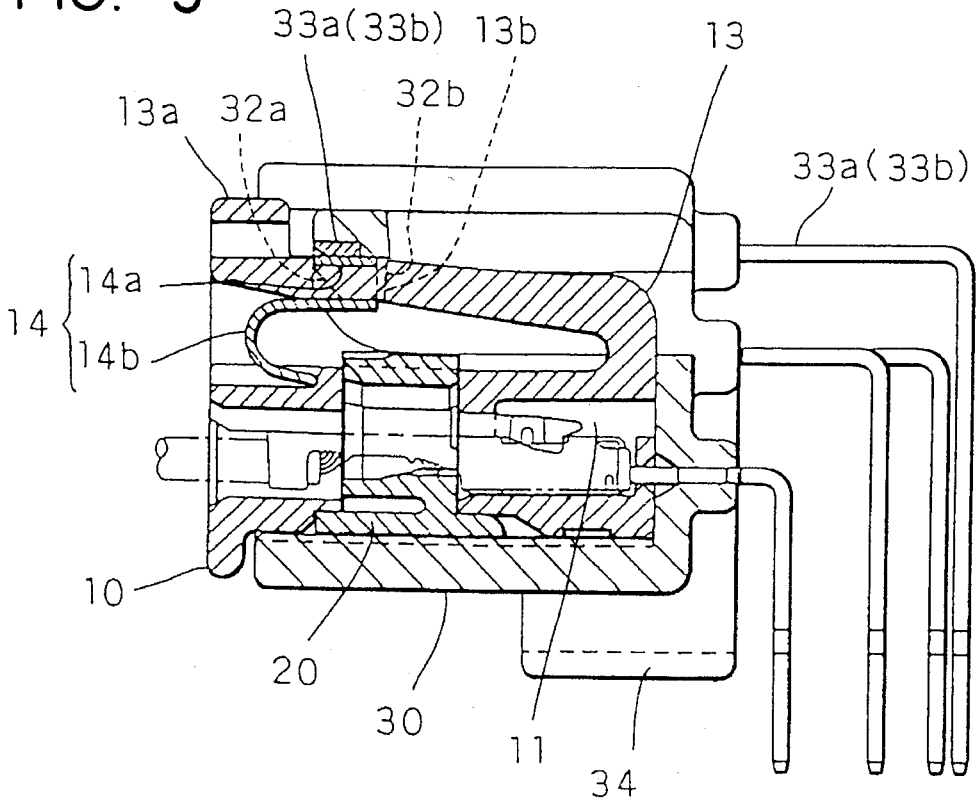
FIG. 5 is another sectional view of the lock connector, particularly showing a procedure for electrically connecting a connector housing on the female side to a connector housing on the male side by way of short-circuiting.

As the female connector housing 10 side is inserted into the male connector housing 30, the inclined part 32*a* of the engagement rib 32 comes in contact with the upper surface of the flexible lock piece 13 at the rear end of the latter, causing the flexible lock piece 13 to be curvedly bent in the downward direction. As shown in FIG. 4, as the female connector housing 10 is inserted into the male connector housing 30 further, the flexible lock piece 13 is displaced in the forward direction while unchangeably maintaining the downwardly bent state. At this time, a pair of electrode portions 14*a* formed on the short circuit electrode 14 are displaced in the downward direction. Thus, although the electrode portions 14*a* reach the position where they are superimposed on the lock detecting electrodes 33*a* and 33*b*, they are not brought in contact with both the lock detecting electrodes 33*a* and 33*b* without any electrical connection made therebetween.

When the female connector housing 10 is inserted into the male connector housing 30 to reach a normal position, the engagement rib 32 faces to the engagement hole 13*b*, and thereafter, it is received in the latter, causing the flexible lock piece 13 to be upwardly pushed back by the action of resiliency of the flexible lock piece 13 itself as well as by the action of resiliency of the spring portion 14*b* of the short circuit electrode 14. In such manner, the female connector housing 10 is engaged with the female connector housing 30 in cooperation of the engagement rib 32 with the engagement hole 13*b*. If a certain intensity of drawing force is applied to the male connector housing 30 so as to disconnect the latter from the female connector housing 10 while maintaining the foregoing state, disconnection of the female connector housing 10 from the male connector housing 30 does not take place because the vertical extending part 32*b* of the engagement rib 32 is held in engagement with the rear side wall surface of the engagement hole 13*b*.

On the other hand, the electrode portions 14*a* of the short circuit electrode 14 are formed in such a manner that a part of the flexible lock piece 13 is seized by the electrode portion 14*a* of the short circuit electrode 14 in the clamped state. In addition, since the lock detecting electrodes 33*a* and 33*b* are arranged on the opposite sides of the engagement rib 32, when the flexible lock piece 13 is upwardly pushed back in that way, the electrode portions 14*a* of the short circuit electrode 14 are electrically connected to both the lock detecting electrodes 33*a* and 33*b* by way of short-circuiting. Specifically, the former are short-circuited to the latter in the same timing relationship as that when the female connector housing 10 is engaged with the male connector housing 30. Since the lock detecting electrodes 33*a* and 33*b* are arranged in the male connector housing 30 which is fixedly secured to the printed circuit base board (not shown), they are reliably held in the male connector housing 30 regardless of any intensity of vibration imparted thereto, whereby the locked state between both the connector housings 10 and 30 can be detected with excellent reliability.

The flexible lock piece 13 itself exhibits elasticity, causing the electrode portions 14*a* of the short circuit electrode 14 to come in contact with the lock detecting electrodes 33*a* and 33*b*. However, as time elapses, the elastic force of the flexible lock piece 13 effective for bringing the electrode portions 14*a* in contact with the lock detecting electrodes 33*a* and 33*b* is increasingly weakened. This leads to the result that the locked state between both the connector housings is erroneously detected due to incorrect contact between the electrode portions 14*a* and the lock detecting electrodes 33*a* and 33*b*. To cope with the foregoing malfunction, in this embodiment, a part of the short circuit electrode 14 serves as a spring portion 14*b*, causing the flexible lock piece 13 to be continuously biased in the upward direction. Thus, the electrode portions 14*a* of the short circuit electrode 14 are continuously brought in engagement with the lock detecting electrodes 33*a* and 33*b* without any possibility that incorrect electrical connection occurs between the electrode portions 14*a* and the lock detecting electrodes 33*a* and 33*b*. In addition, since the electrode portions 14*a* are integrated with the short circuit electrode 14 including the spring portion 14*b*, there does not arise a malfunction that the number of components constituting the lock connector is undesirably increased.

In such manner, the short circuit electrode 14 made of a metal in the form of a leaf spring is disposed between the flexible lock piece 13 and the recess 12 of the female connector housing 10 to assists in normally biasing the flexible lock piece 13, and moreover, the electrode portions 14*a* of the short circuit electrode 14 seized by the flexible lock piece 13 constitute an electrode for the lock connector by utilizing electrical conductivity of the short circuit electrode 14.

As is best seen in FIG. 2, the engagement rib 32 is interposed between both the lock detecting electrodes 33*a* and 33*b* while projection forward of the latter to serve as a partition wall for separating them away from each other. If the partition wall is not formed between both the lock detecting electrodes 33*a* and 33*b*, short-circuiting is liable to occur due to adhesion of water droplets to the surface extending therebetween. However, the formation of the engagement rib 32 in the above-described manner prevents the foregoing malfunction from practically arising.

In practice, disconnection of the male connector housing 30 from the female connector housing 10 is achieved by way of the steps of depressing a seizing portion 13*b* of the flexible lock piece 13 toward the bottom of the recess 12, disengaging the engagement rib 32 from an engagement hole 13*b* and then drawing the male connector housing 30 out of the female connector housing 10.

In such manner, the female connector housing 10 includes the flexible lock piece 13 and the short circuit electrode 14 adapted to seize a part of the flexible lock piece 13 with the aid of the electrode portions 14*a*, and the female connector housing 30 holds a pair of lock detecting electrodes 33*a* and 33*b* at the position where the latter come in contact with the short circuit electrode 14 via the engagement rib 32 by the elastic restoring action of the flexible lock piece 13 induced by deflection of the latter. Thus, the elastic restoring action of the flexible lock piece 13 and the short-circuiting between two opponent terminals are simultaneously achieved without any deviation from the correct timing relationship established among these components.

As is apparent from the above description, with the lock connector constructed in the above-described manner, since the engagement hole 13*b* is formed through the flexible lock piece 13 of the female connector housing 10, the short circuit electrode 14 is disposed in the recess 12 while seizing the flexible lock piece 13 therewith, the engagement rib 32 projecting toward the flexible lock piece 13 is formed on the male connector housing 30, and both the lock detecting electrodes 33*a* and 33*b* are disposed on the opposite side of the engagement rib 32, the lock connector can be constructed in a compact manner without any formation of a protuberance on the flexible lock piece 13 while assuring that the engagement rib 32 reliably separates both the lock detecting electrodes 33*a* and 33*b* away from each other, and moreover, electrical insulativeness of the lock connector is substantially improved.

In the aforementioned embodiment, the short circuit electrode 14 having the electrode portion 14*a* and the spring portion 14*b* formed integral with each other is employed for the lock connector. Alternatively, the electrode portions 14*a* may be separated from the spring portion 14*b*. Otherwise, the short circuit electrode 14 may be constructed only by the electrode portions 14*a*.

Figure 9:
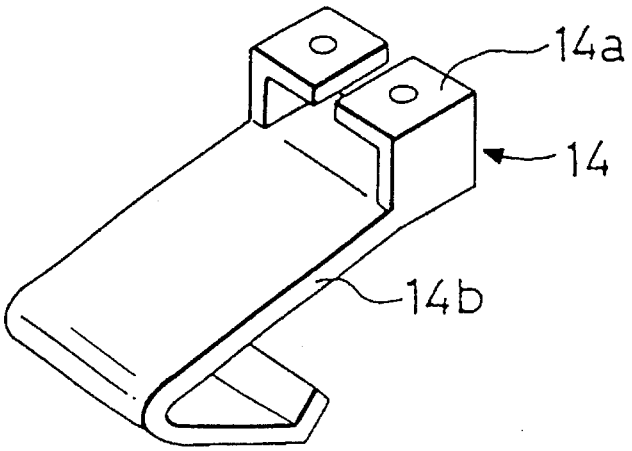
FIG. 9 is perspective view of a short circuit electrode for a lock connector constructed according to another embodiment of the present invention.
Figure 10:
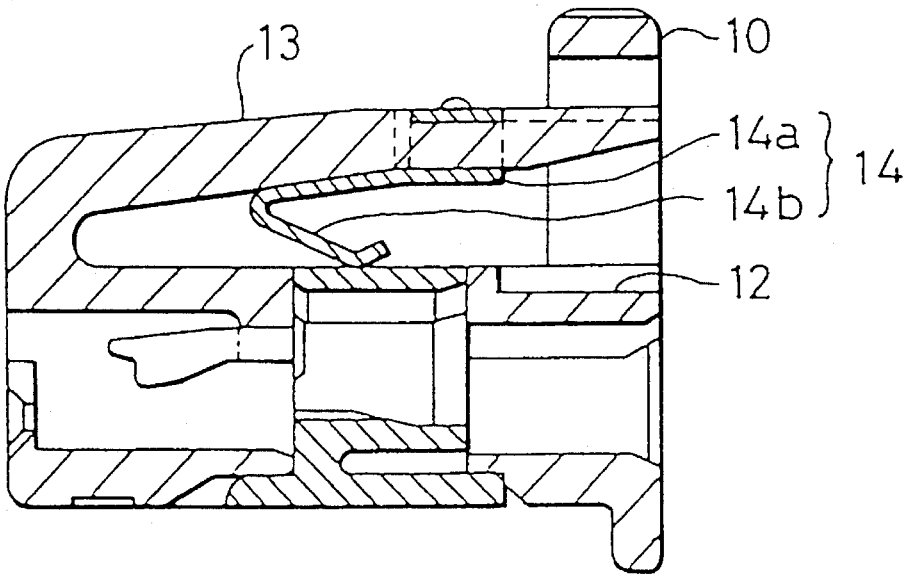
FIG. 10 is a sectional view of a connector housing on the female side having the short circuit electrode received therein.
Figure 11:
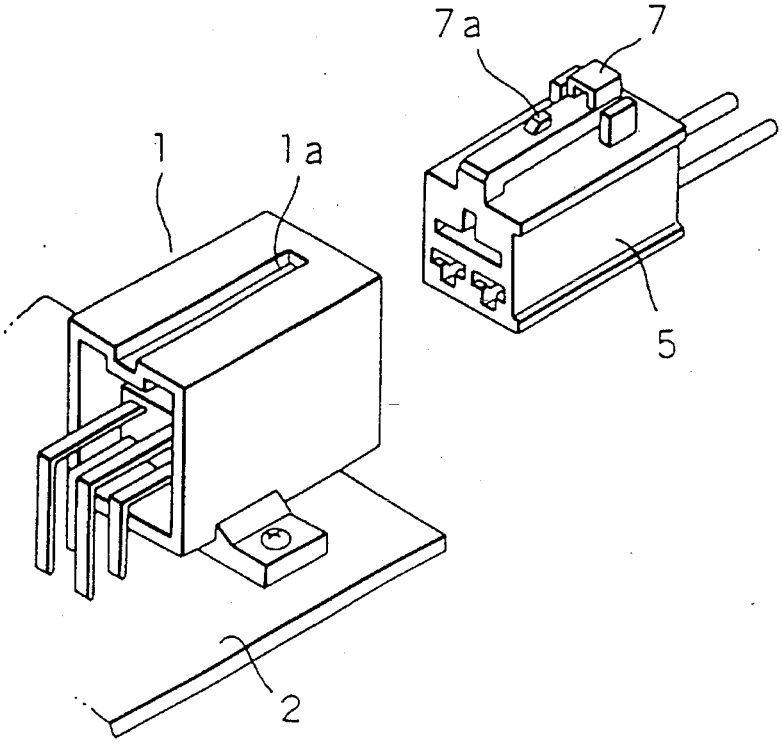
FIG. 11 PRIOR ART
FIG. 11 is a perspective view of a conventional lock connector.
Figure 12:
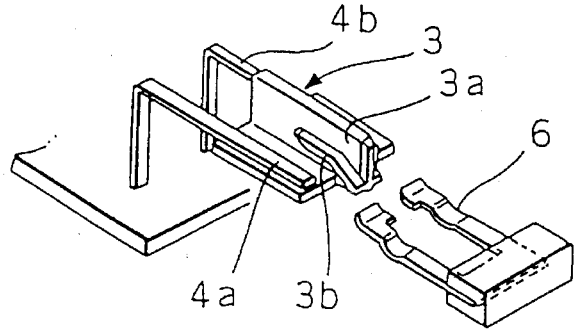
FIG. 12 PRIOR ART
FIG. 12 is a perspective view of a short circuit electrode and a lock detecting electrode employed for the conventional lock connector shown in FIG. 11.
Figure 13:
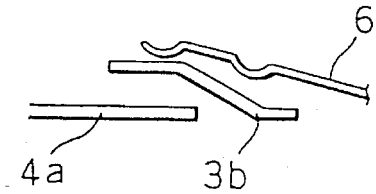
FIG. 13 PRIOR ART
FIG. 13 is a fragmentary side view of the conventional lock connector shown in FIG. 11, particularly showing how the short circuit electrode and the lock detecting electrode are electrically connected to each other by way of short-circuiting.
Figure 14:
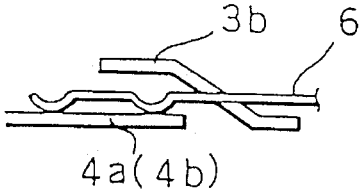
FIG. 14 PRIOR ART
FIG. 14 is another fragmentary side view of the conventional lock connector shown in FIG. 11, particularly showing how the short circuit electrode and the lock detecting electrode are electrically connected to each other by way of short-circuiting.

In the preceding embodiment, the spring portion 14*b* of the short circuit electrode 14 is located on the fore side of the flexible lock piece 13. However, a spring portion 14*b* of the short circuit electrode 14 may be located on the rear side of the flexible lock piece 13 as shown in FIG. 9 and 10.

Figure 6:
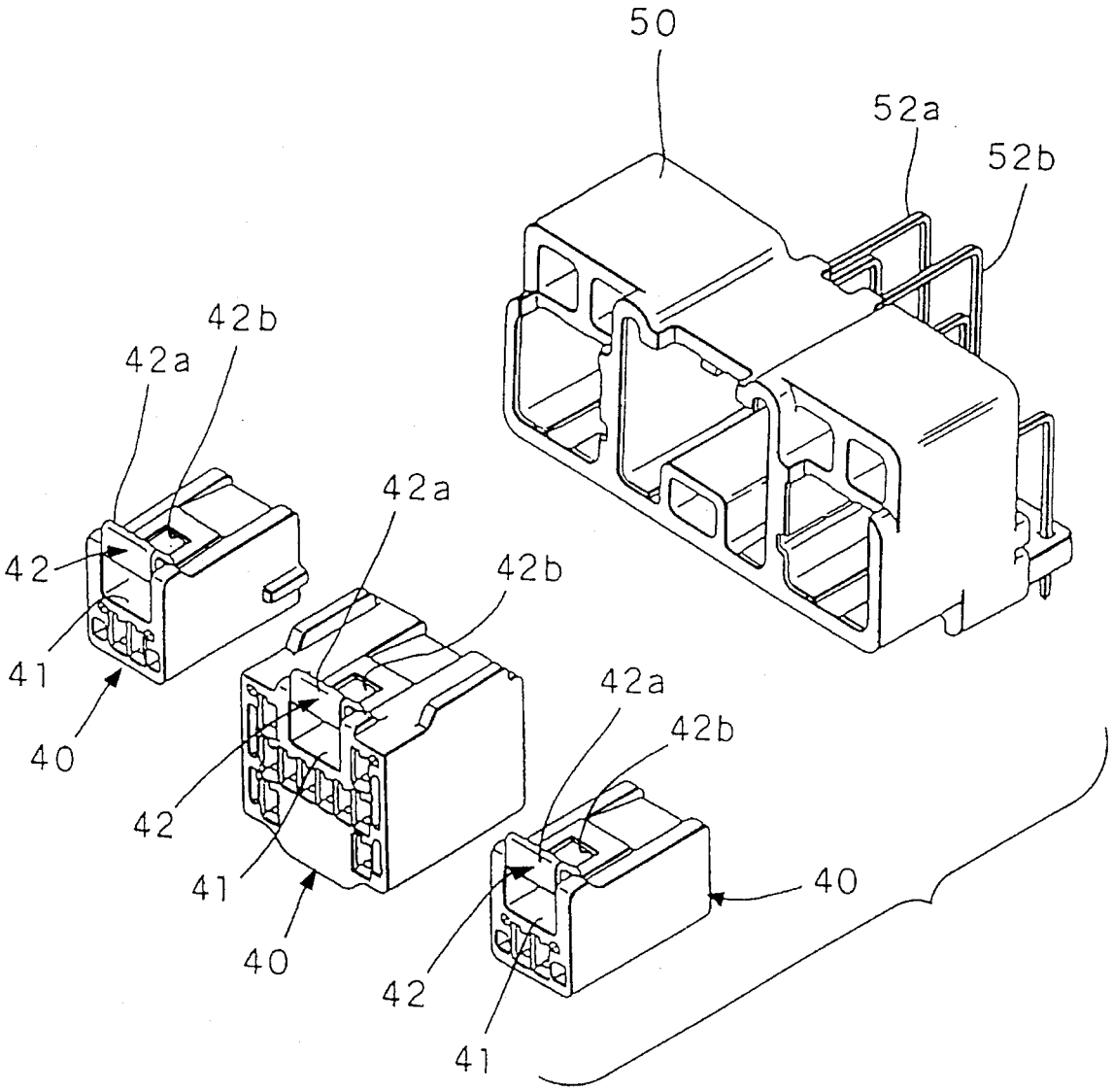
FIG. 6 is a perspective view of a lock connector constructed according to another embodiment of the present invention.
Figure 7:
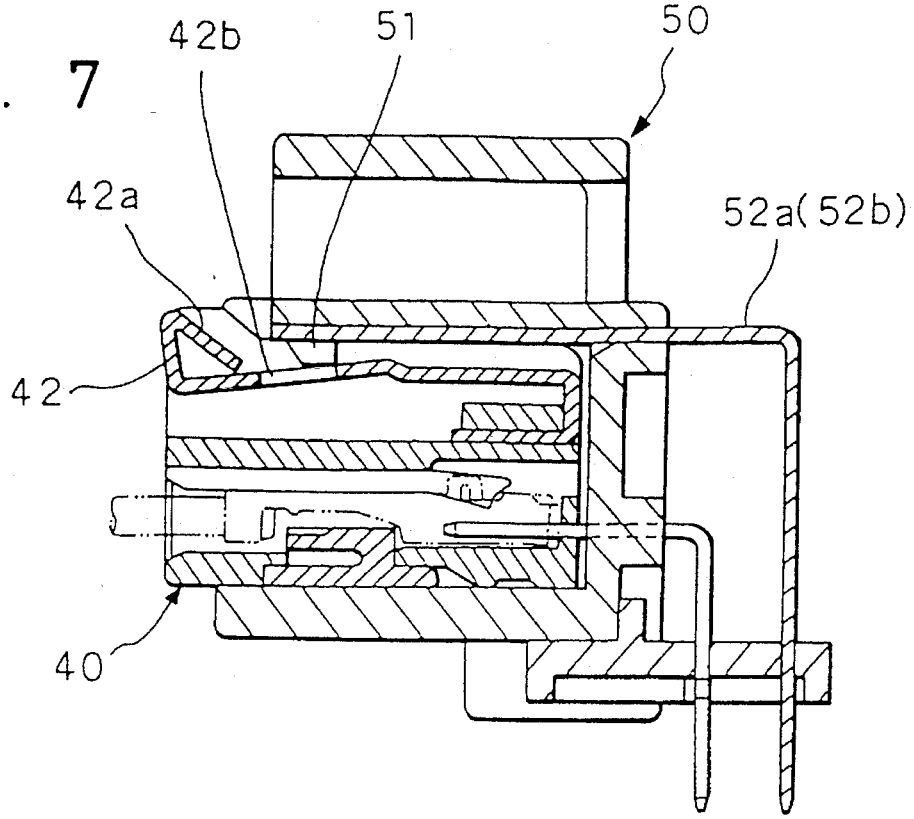
FIG. 7 is a sectional view of the lock connector, particularly showing a procedure for electrically connecting a connector housing on the female side to a connector housing on the male side by way of short-circuiting.
Figure 8:
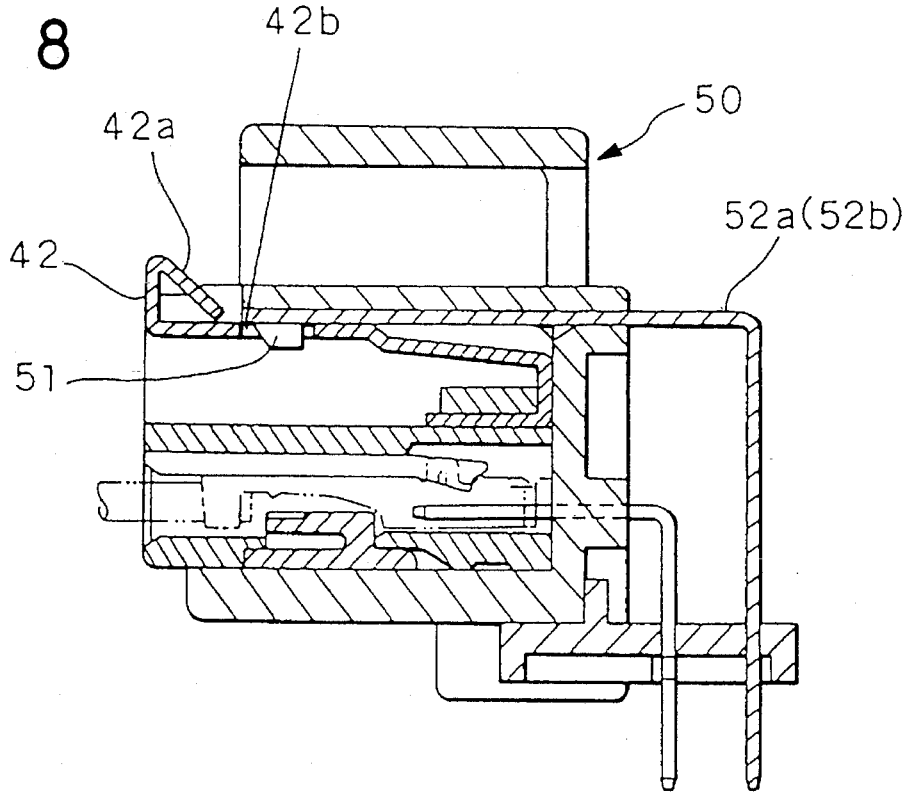
FIG. 8 is another sectional view of the lock connector, particularly showing a procedure for electrically connecting a connector housing on the male side to a connector housing on the male side by way of short-circuiting.

Next, FIG. 6, FIG. 7 and FIG. 8 show a lock connector constructed according to another embodiment of the present invention, respectively. In this embodiment, a recess 41 is formed on the upper surface of each female connector housing 40 in the same manner as the preceding embodiment. In addition, a flexible lock piece 42 made of a metal is disposed in each recess 12. The flexible lock piece 42 is fixedly secured to the upper surface of each female connector housing 40 at the rear end part thereof, and the fore end part of each flexible lock piece 42 is resiliently displaced in the upward/downward direction. A pinching portion 42*a* is formed at the foremost end part of the flexible lock piece 42, and an engagement hole 42*b* is formed through the flexible lock piece 42 at the position located behind the pinching portion 42*a*.

On the other hand, an engagement rib 51 is formed on the ceiling surface of a male connector housing 50 in the same manner as the preceding embodiment, and a pair of lock detecting electrodes 52*a* are arranged on the opposite sides of the engagement rib 51.

With this construction, as the female connector housing 40 is inserted into the male connector housing 50, the flexible lock piece 42 is curvedly bent by the engagement rib 51 in the downward direction. When the female connector housing 40 is inserted into the male connector housing 50 to reach a predetermined position, each engagement rib 51 is received in the engagement hole 42*b*, causing the flexible lock piece 41 to be restored to the original position, whereby the lock detecting electrodes 52*a* and 52*b* are electrically connected to the corresponding flexible lock piece 42 by way of short-circuiting.

What is claimed is:

1. A lock connector comprising:

first connector housing having a flexible lock piece formed thereon;

second connector housing having an engagement portion formed thereon to be engaged with said flexible lock piece;

a detecting member for detecting the locked state between the first and second connector housings, said detecting member comprising:

a pair of lock detecting electrodes disposed on said second connector housing where said flexible lock comes in contact with said engagement portion, and a short circuit electrode disposed on the upper surface of said first connector housing where said flexible lock piece is urged toward said engagement portion, said short circuit electrode electrically connecting said pair of lock detecting electrodes when said flexible lock piece is engaged with said engagement portion in said locked state; and a U-shaped leaf spring including a first leg contacting the flexible lock piece, a second leg contacting a side of said first housing, and a connection portion connecting the first and second legs, said connection portion being adjacent a distal free end of the flexible lock piece in said locked state.

2. A lock connector as claimed in claim 1, wherein one of said first and second connector housings is fixedly secured to a member to be mounted.

3. A lock connector as claimed in claim 1, wherein said U-shaped leaf spring and said pair of short circuit electrode portions comprise an integral unit.

4. A lock connector as claimed in claim 1, wherein said second connector housing includes a partition wall extending toward the flexible lock piece of said first connector housing so that said pair of lock detecting electrodes are disposed with said partition wall interposed therebetween, and said first connector includes an engagement hole for receiving a part of said partition wall in engagement with said engagement hole at the position located opposite to said partition wall while said flexible lock piece is brought in contact with said engagement portion.

5. A lock connector comprising:

a first connector housing having a generally U-shaped, metallic flexible lock piece formed thereon, one end of the metallic flexible lock piece being fixably connected to the first connector housing;

a second connector housing having an engagement portion disposed therein to be engaged with said metallic flexible lock piece; and a pair of lock detecting electrodes formed on said second connector housing where said metallic flexible lock piece comes into contact with said engagement portion, wherein said metallic flexible lock piece is electrically connected to said pair of lock detecting electrodes when said metallic flexible lock piece is engaged with said engagement portion.

6. A lock connector as claimed in claim 5, wherein said second connector housing includes a engagement projection projecting between said pair of lock detecting electrodes toward the metallic flexible lock piece of said first connector housing.

* * * * *